US007423245B2

(12) United States Patent
Baumgart

(10) Patent No.: US 7,423,245 B2
(45) Date of Patent: Sep. 9, 2008

(54) NOSE COVER

(75) Inventor: Jörg Baumgart, Herdwangen-Schönach (DE)

(73) Assignee: Diehl BGT Defence GmbH & Co., KG, Überlingen (DE)

( * ) Notice: Subject to any disclaimer, the term of this patent is extended or adjusted under 35 U.S.C. 154(b) by 173 days.

(21) Appl. No.: 11/259,402

(22) Filed: Oct. 26, 2005

(65) Prior Publication Data

US 2006/0208131 A1 Sep. 21, 2006

(30) Foreign Application Priority Data

Nov. 5, 2004 (DE) ..... 10 2004 053 449

(51) Int. Cl.

| | |
|---|---|
| ***H01Q 1/42*** | (2006.01) |
| ***F42B 12/72*** | (2006.01) |
| ***G12B 17/08*** | (2006.01) |
| *F42B 12/00* | (2006.01) |

(52) U.S. Cl. ..... 244/3.1; 244/3.15; 244/3.16; 244/117 R; 244/119; 244/121; 343/872

(58) Field of Classification Search ..... 244/3.1–3.3, 244/117 R, 119, 121; 343/872, 873; 102/293, 102/501

See application file for complete search history.

(56) References Cited

U.S. PATENT DOCUMENTS

| | | | | |
|---|---|---|---|---|
| 2,674,420 | A * | 4/1954 | Johnson | 244/3.15 |
| 2,854,668 | A * | 9/1958 | McMillan et al. | 343/872 |
| 3,063,654 | A * | 11/1962 | Yongren et al. | 343/872 |
| 3,081,051 | A * | 3/1963 | Robinson, Jr. | 244/3.15 |
| 3,128,466 | A * | 4/1964 | Brown et al. | 343/872 |
| 3,195,138 | A * | 7/1965 | Beck | 343/872 |
| 3,316,549 | A * | 4/1967 | Hallendorff | 343/872 |
| 3,396,396 | A * | 8/1968 | Charlton et al. | 343/872 |
| 3,555,550 | A * | 1/1971 | Walters | 343/872 |
| 3,925,783 | A * | 12/1975 | Bleday et al. | 343/872 |
| 4,091,388 | A * | 5/1978 | Fiscus | 343/872 |
| 4,275,859 | A * | 6/1981 | Bleday | 343/872 |
| 4,303,211 | A * | 12/1981 | Dooley et al. | 244/3.19 |
| 4,725,475 | A * | 2/1988 | Fiscus et al. | 343/872 |
| 4,797,683 | A * | 1/1989 | Kosowsky et al. | 343/872 |
| 4,933,683 | A * | 6/1990 | Lohmann | 343/872 |

(Continued)

FOREIGN PATENT DOCUMENTS

EP 0369958 A2 * 5/1990

(Continued)

OTHER PUBLICATIONS

Trotta, "Precision Conformal Optics Technology Program", *Window and Dome Technologies and Materials VII*, Proceedings of SPIE, vol. 4375, pp. 96-103, Apr. 16-17, 2001.

*Primary Examiner*—Bernarr E Gregory
(74) *Attorney, Agent, or Firm*—Scully, Scott, Murphy & Presser, P.C.

(57) ABSTRACT

A nose cover (10) for a dome (12) through which radiation can pass, for a missile, the nose cover having an outer structure (22) through which radiation can pass and which is aerodynamically better than a spherical shape, and having correction optics (24) through which radiation can pass and which can be placed in front of the dome (12). The nose cover (10) makes it possible to retrofit older missiles such that they have a greater range without this necessitating any modification of the existing structure of the missile.

7 Claims, 1 Drawing Sheet

U.S. PATENT DOCUMENTS

| | | | | |
|---|---|---|---|---|
| 5,167,386 | A * | 12/1992 | Laquer et al. | 343/872 |
| 5,691,736 | A * | 11/1997 | Hunn et al. | 343/872 |
| 6,845,719 | B1 | 1/2005 | Spencer | |
| 6,854,393 | B2 * | 2/2005 | Hazan | 102/501 |
| 7,093,799 | B1 * | 8/2006 | Dulat et al. | 343/872 |
| 2005/0223930 | A1 | 10/2005 | Bootes et al. | |
| 2005/0229807 | A1 | 10/2005 | Brock et al. | |

FOREIGN PATENT DOCUMENTS

| | | | |
|---|---|---|---|
| EP | 1 369 734 | A1 | 12/2003 |
| GB | 1 363 495 | A | 7/1970 |

* cited by examiner

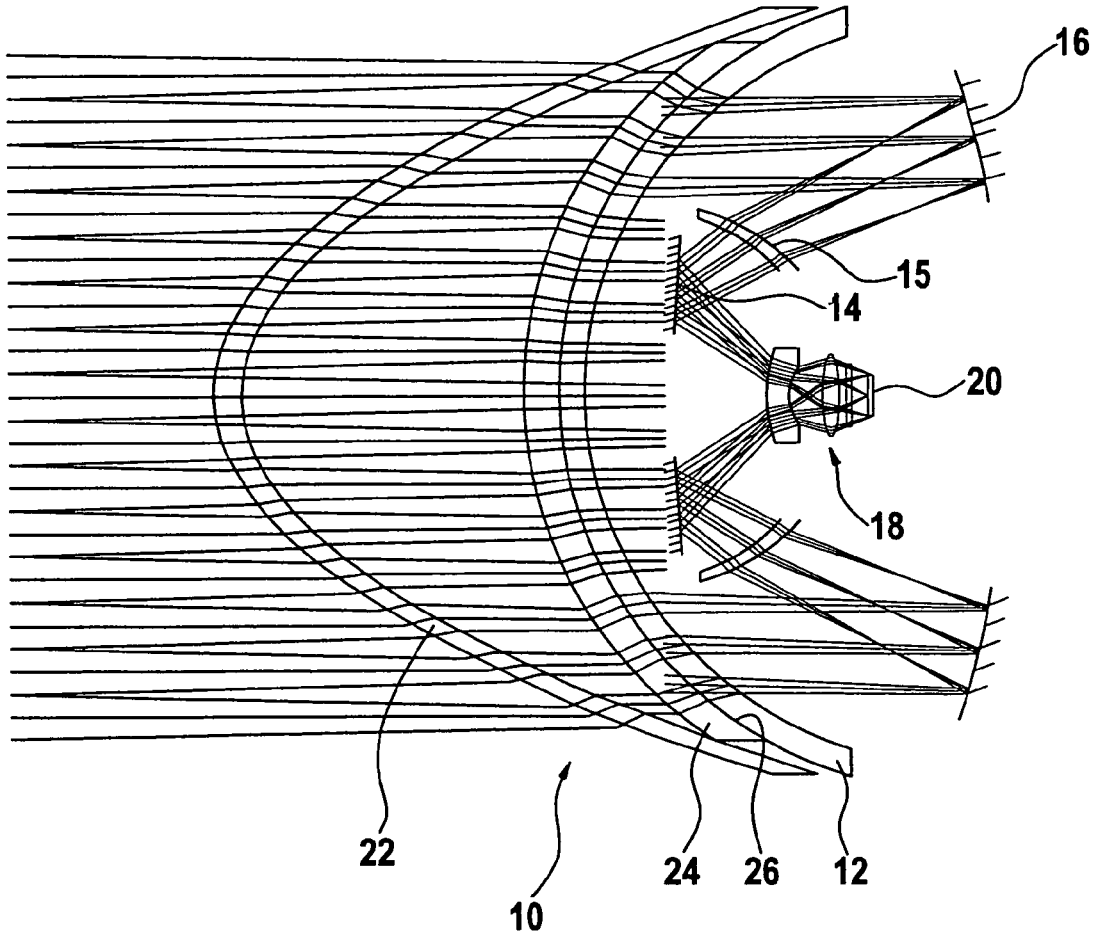
16
15
14
20
18
22
10
24
26
12

NOSE COVER

BACKGROUND OF THE INVENTION

1. Field of the Invention

The invention relates to a nose cover for a dome, through which radiation can pass, for a missile.

In the case of missiles, particularly in the case of guided missiles which respond to infrared radiation, the nose of the missile is formed by a dome through which radiation can pass. Search-head optics and a detector which is sensitive to radiation and by means of which the missile can detect targets are arranged behind the dome, in the interior of the missile. A dome such as this is typically spherical. This is due on the one hand to the fact that hemispherical—that is to say spherical—domes can be produced relatively easily and accurately, and on the other hand to the fact that, when the search-head optics are being scanned about the centre of curvature of the dome, there are no influences that are dependent on the position of the search-head optics on the beam path striking the dome, after the beam has passed through the dome. The optical effect of a spherical or hemispherical dome is thus always the same even when the alignment of the search-head optics changes. A spherical dome thus offers the capability to scan observation areas as far as the hemisphere boundaries without any adverse effects on the imaging.

2. Discussion of the Prior Art

However, spherical domes have comparatively high aerodynamic drag. Conformal optics are known from the article "Precision Conformal Optics Technology Program" by Patrick A. Trotta (which appeared in the Proceedings of SPIE, Window and Dome Technologies and Materials VII, Volume 4375, April 2001). These conformal optics are optics which do not have the conventional—that is to say spherical—shape, in order to reduce the aerodynamic drag of missiles. A conformal dome therefore produces less drag than a spherical dome, hence increasing the speed of the missile and/or its range. However, in contrast to a hemispherical dome, the optical effect of a conformal dome is dependent on the alignment of the search-head optics. It is no longer possible to cover a hemispherical observation area. In order to overcome this problem, correction optics are provided which make it possible to enlarge the field of a view, which is constricted by the conformal dome. However, correction optics can overcome this defect only in a very restricted range.

As a consequence of this, all that is possible is to produce missiles which either achieve only a low speed because of their spherical dome, or have a short range owing to their spherical dome, but which allow scanning of a hemispherical observation area, or which achieve a high speed and have a long range owing to their conformal dome, but which allow only a restricted field of view to be scanned.

SUMMARY OF THE INVENTION

The object of the invention is thus to specify a nose cover for a dome, through which radiation can pass, for a missile, with which it is possible to retrospectively retrofit a missile which is already provided with a dome, in such a way that it can be used when required for missile missions which require not only a long missile range but also coverage of a specific field of view, in order to carry out these missions successfully.

According to the invention, this object is achieved by the nose cover for a dome through which radiation can pass, for a missile, having an outer structure through which radiation can pass and which is aerodynamically better than a spherical shape, and having correction optics through which radiation can pass and which can be placed in front of the dome.

A first step of the invention is based on the discovery that an outer structure which is aerodynamically better than the spherical shape has less drag than a spherical shape. Less drag means a greater maximum speed can be achieved, so that the maximum achievable range of a missile is increased.

A further step of the invention is based on the idea that, if radiation can pass through the outer structure, correction optics through which radiation can pass make it possible for the missile to cover a specific field of view by means of its search-head optics.

A next step of the invention is based on the idea that conversion of a missile is time-consuming and expensive, must be planned well in advance, and it must be clear that the missiles with which, for example, an aircraft is intended to be fitted in order to allow a missile such as this are also to be available for a missile mission in the case of a specific requirement. In this case, the expression conversion means direct action on a missile which has already been completed, with this action being associated with replacement of its original dome. In order to ensure that it is still possible to scan a specific field of view after replacement of the original dome, it is generally necessary to use new search-head optics, which are matched to the aerodynamically better shape of the new dome and are adapted to it, possibly as well as further optical elements for beam path correction and guidance, which replace the previous search-head optics. On the other hand, a nose cover which comprises an outer structure and correction optics and which can be fitted to a dome that is already located on the missile means that there is no need to remove the original dome, to modify the design, or to completely replace its search-head optics.

The invention thus provides a nose cover which allows already existing, older missiles to be retrofitted as required with an aerodynamically poorly shaped dome without major effort and without costly, complex modifications in the area of the original dome and of the search-head optics for the missile in such a way that the missiles can travel over greater flight distances and can at the same time scan a specific field of view.

The nose cover with its outer structure and its correction optics which can be placed in front of the dome in this case allow so-called null optics to be formed with respect to the subsequent dome and the search-head optics in the missile. In this case, null optics means that the optical effect of the nose cover remains the same in a specific field of view range around the centre of curvature of the original dome of the missile, that is to say, in this region, its effect on the missile is as if it were not present at all.

The nose cover can advantageously be jettisoned. The advantage of this refinement of the invention will become particularly clear if one considers the various operational scenarios for missiles. In this case, the operational scenarios may essentially be subdivided into two groups. In one group, the distance between the missile and its target corresponds approximately to the missile range. In this operational scenario, the range of the missile is of very major importance for a successful missile mission. In this situation, any escape manoeuvre by the target means only a minor change in the line of sight. This means that only a slight change in the angle of the search-head optics is required within a small angular range around the centre of curvature of the dome of the missile. There is therefore no need for the missile to be able to cover as wide a field of view as possible without any error. In the other group of operational scenarios, in contrast, the distance between the missile and its target is small in comparison to the missile range. The range of the missile is thus of secondary importance in this operational scenario. In this case, in contrast, the requirement is for the missile to be able to cover as wide a field of view as possible. This is because any escape manoeuvre by the target in this case quickly leads to relatively large changes in the line of sight. Thus, in order to ensure that the missile remains aligned with the target and does not lose it, it must be able to cover a wide field of view. This means that its search-head optics must be able to scan a wide angular range—best of all covering the complete hemisphere—about the centre of curvature of its dome while nevertheless at the same time ensuring error-free target detection, in order not to endanger the missile mission. Obviously, the operational scenario described first of all changes to the operational scenario that has just been described once the missile has travelled over a certain distance. This is because, as soon as a missile is in the terminal approach phase to its target, it has to travel only a short distance further, but in some circumstances must also be able to cover a wide field of view. If the nose cover can now be jettisoned, then the range of the missile can be increased as it approaches the target through the use of the nose cover while subsequent jettisoning of the nose cover in the terminal phase of target approach ensures that the missile detects its target and that the missile mission is successfully completed. A further positive side-effect of a nose cover which can be jettisoned is the fact that it also provides protection for the actual dome of the missile during the approach flight of the missile (which lasts for a long time in comparison to the terminal phase) to its target. Damage to the nose cover resulting from being struck by stones, rain erosion or sand erosion thus has an effect, for example, only while the missile is being carried on an aircraft and in the first phase of target approach. Since, however, exact target detection is in this case not of such major importance as when the missile is in the terminal approach phase to its target, damage such as this can be accepted without any need to be concerned about endangering the missile mission. Once the protective nose cover has been jettisoned in the terminal phase of target approach, an undistorted dome is available, guaranteeing a high probability of target detection.

Options for separation of a nose cover are sufficiently well known to those skilled in the art. For example, it is possible to provide for an attachment apparatus for the nose cover to be blown off pyrotechnically.

In one advantageous refinement of the invention, the correction optics can be fitted in an interlocking manner on the dome of the missile. Fitting of the correction optics in an interlocking manner serves to avoid damage to the mutually facing outer surfaces of the correction optics and the dome which may result, for example, from the possible ingress of dust particles. This also results in a homogeneous temperature distribution on the dome of the missile. This results in good imaging quality of a field of view—owing to the reduction of the local hotspots which corrupt the image—on a radiation-sensitive detector in the missile, thus at the same time increasing the probability of a successful missile mission.

The aerodynamically improved outer structure of the nose cover expediently has a conical, ogive or paraboloid geometry. All previously known geometries have a lower coefficient of drag than that of a spherical shape. Since the geometry-dependent coefficient of drag is directly proportional to the drag, an outer structure shaped in this way allows the missile drag to be greatly reduced, thus positively influencing its flying characteristics. Reduced drag allows the missile to travel over a comparatively longer distance and/or to reach a target at the same distance in a shorter time owing to its higher speed. This improves the effectiveness of the missile. Furthermore, a geometry such as this makes it possible to achieve a reduction in the missile signature, thus making it more difficult for the enemy to detect the missile and thus to intercept it or destroy it before it reaches its target. Furthermore, geometries such as these influence the flow field in such a way that aerodynamic heating of the nose cover and of the missile dome located behind it is kept low. This avoids adverse effects on the imaging quality on a radiation-sensitive detector located in the missile, resulting from corrupting heat distributions on the nose cover and on the dome of the missile.

It is particularly clever for the outer surface of the correction optics which face the dome of the missile to be concave and spherical. A nose cover designed in this way can be fitted particularly well to a missile with a hemispherically shaped dome. Furthermore, spherical outer surfaces can be produced geometrically more exactly than, for example, aspherical outer surfaces. The correction optics thus ensure good compensation for the optical effect of the outer structure of the nose cover on the missile dome behind it.

It is particularly advantageous for the outer structure to be manufactured from magnesium fluoride. Magnesium fluoride is a material which has a transmission of 95%, with respect to a material thickness of 2 mm, in a transmission range from 2 to 7.5 μm. In addition to high transmission in the infrared spectral band, magnesium fluoride is also able to withstand the high temperatures, pressures and possible mechanical damage occurring during a missile mission. It is also feasible to use the following materials, which are transparent in the infrared spectral band, as material for the outer structure: magnesium oxide, zinc sulphite, aluminium oxinitrite, diamond, germanate glass, germanium, calcium aluminate glass, quartz, sapphire, silicon, spinell or yttrium oxide.

It is also advantageous for the correction optics to be in the form of a germanium lens. A germanium lens makes it possible to compensate specifically for imaging errors resulting from chromatic aberration caused by the outer structure. This means that the nose cover, with its outer structure and its correction optics in the form of a germanium lens, acts as null optics in a specific field of view range around the centre of curvature of the dome of the missile, thus ensuring reliable target detection in this area.

Appropriate geometric shaping of the nose cover and choice of material make it possible to ensure that the optical effect of the nose cover on the search-head optics remains the same in an angular range of at least 20° around the centre of curvature of the missile dome.

In a highly practical manner, it is possible to provide for the correction optics—in the event of known imaging errors of the missile dome and of its search-head optics on a radiation-sensitive detector—not only to provide compensation for the influence of the outer structure of the nose cover on a beam path, but also in addition to provide correction for the imaging errors of the dome and of the search-head optics. This has a lasting positive influence on the effectiveness of the missile. The probability of target detection and possible destruction of a target being aimed at is increased.

BRIEF DESCRIPTION OF THE DRAWING

One exemplary embodiment of the invention will be explained in more detail with reference to a drawing. The single figure of the drawing shows a nose cover with correction optics and with an outer structure which is aerodynamically better than a spherical shape.

DETAILED DESCRIPTION OF THE INVENTION

The figure shows a nose cover 10 which is arranged on a hemispherical dome 12 of a missile. In its interior behind its dome 12, the missile has catadioptric elements 14, 15 and 16, which are provided for imaging of a beam path on search-head optics 18 which can be scanned with respect to the centre of curvature of the dome 12. The search-head optics 18 then image an incident beam path on a radiation-sensitive detector 20 which is located behind it. The nose cover 10 has a paraboloid outer structure 22. The outer structure 22 is manufactured from magnesium fluoride. A germanium lens is provided as the correction optics 24. The outer surface 26 of the germanium lens facing the dome 12 is concave and spherical.

The germanium lens can thus be fitted in an interlocking manner onto the spherical dome 12. The detailed design values for the outer structure 22 and for the germanium lens can be found in the following table. The data for the aspherical outer structure is defined in accordance with the following formula for aspherical surfaces:

$$z = \frac{cvr^2}{1 + \sqrt{1 - cv\,(cc + 1)r^2}} = adr^4 + aer^6 + afr^8 + agr^{10}$$

r in this case denotes the radius of the outer structure 22, cv the curvature and cc the conical constant. ad, ae, af and ag are aspherical coefficients. Aspherical coefficients (af, ag) which are not quoted are zero in the present example. The nose cove 10 has a focal length f of 2.626 inches with a numerical aperture NA of 0.4189. Those skilled in the art will be able to easily adapt the design value and the materials used for the outer structure 22 and correction optics 24 to the requirements of a respective missile that is to be retrofitted.

TABLE

Design data for the nose cover 10

| | Radius (in) | Thickness (in) or distance (in) | Aperture radius (in) | Material | Comments |
|---|---|---|---|---|---|
| Object plane | | | | Air | |
| 1 | 0.5 | 0.086 | 1.323 | Magnesium fluoride | Outer structure 22 |
| 2 | 0.480829 | 0.9 | 1.323 | Air | Distance to the germanium lens |
| 3 | 1.508341 | 0.11 | 1.2 | Germanium | Germanium lens |
| 4 | 1.423 | | 1.2 | Air | |

TABLE-continued

Design data for the nose cover 10

Aspherical data (conical and polynomial) for the outer structure 22

| | CC | AD | AE |
|---|---|---|---|
| 1 | −1 | | |
| 2 | −1 | | |
| 3 | 0.010923 | 0.001444 | −0.000909 |

List of Symbols

10 Nose cover
12 Dome
14 Catadioptric element
15 Catadioptric element
16 Catadioptric element
18 Search-head optics
20 Detector
22 Outer structure
24 Correction optics
26 Outer surface.

The invention claimed is:

1. Nose cover (10) for a dome (12) of a missile, enabling infrared radiation to pass through said dome (12), said nose cover having a hollow interior and possessing an outer aspherically configured surface structure (22) and facilitating passage of said infrared radiation therethrough, and correction optics (24) through which said infrared radiation passes being positioned fitted in an interlocking manner on a surface of the dome (12) facing the interior of said nose cover (10).

2. Nose cover (10) according to claim 1, wherein the nose cover is pyrotechnically jettisonable from said missile.

3. Nose cover (10) according to claim 1, wherein the aspherically configured outer surface structure (22) of said nose cover (10) has selectively a conical, ogive or paraboloid geometry.

4. Nose cover (10) according to claim 1, wherein an outer surface (26) of the correction optics (24) positioned on the surface of the dome (12) of the missile is concave and spherical in shape.

5. Nose cover (1) according to claim 4, wherein said dome (12) has a generally spherical configuration, said outer surface (26) of the correction optics (24), which faces said dome (123) being interlockingly fittable onto said dome (12).

6. Nose cover (10) according to claim 1, wherein the aspherically configured outer surface structure (22) of said nose cover (10) is selected from the group of materials consisting of magnesium fluoride, magnesium oxide, zinc sulphite, aluminum oxinitrite, diamond, germinate glass, germanium, calcium, aluminate glass, quartz, sapphire, silicon, spinell, and yttrium oxide.

7. Nose cover (10) according to claim 1, wherein the correction optics (24) are in the form of a germanium lens.

* * * * *